US005348220A

United States Patent [19]

Setteducati

[11] Patent Number: 5,348,220

[45] Date of Patent: Sep. 20, 1994

[54] SAVINGS BOX

[75] Inventor: Mark Setteducati, New York, N.Y.

[73] Assignee: Tenyo Co., Ltd., Tokyo, Japan

[21] Appl. No.: 34,725

[22] Filed: Mar. 22, 1993

[51] Int. Cl.[5] ..... A45C 1/12

[52] U.S. Cl. ..... 232/1 D; 472/63; 446/10; 446/219; 40/445

[58] Field of Search ..... 232/1 D; 446/10, 12, 446/8, 219; 472/13, 71; 40/900, 445, 219

[56] References Cited

U.S. PATENT DOCUMENTS

| | | | |
|---|---|---|---|
| 282,978 | 8/1883 | Goudie | 446/8 |
| 704,239 | 7/1902 | Grannell | 446/8 |
| 3,143,285 | 8/1964 | Fulton | 446/8 |
| 4,967,953 | 11/1990 | Sugawara | 446/8 |
| 5,282,765 | 2/1994 | Suzuki | 446/8 |

FOREIGN PATENT DOCUMENTS

| | | | |
|---|---|---|---|
| 688925 | 1/1930 | France | 40/219 |

*Primary Examiner*—Flemming Saether
*Attorney, Agent, or Firm*—Robert W. J. Usher

[57] ABSTRACT

A savings box housing comprises a front panel with a transparent window and an opaque rear panel and light-opaque side panels extending from the front to the rear panels. The front and rear panels are disposed symmetrically with respect to a partition located in a plane extending across a central location of the housing interior to divide the housing interior into a front compartment on the window side and a rear compartment on the rear-panel side. A mirror extends over substantially the entire surface of a front side of the partition facing the window. A slide assembly consisting of two slides mounted in slots formed in the housing wall on respective opposite sides of the partition for receipt in the front and rear spaces, respectively, is provided in the housing for sliding movement between a first, coin receiving position, in which the slide assembly is withdrawn from the housing enabling a coin to be set on the slide assembly and, a second, coin depositing position in which the slides are received in the front and rear compartments, respectively, with the coin deposited by the rear slide in the rear compartment concealed during deposit behind the mirror surface and partition so that it cannot be seen through the window, providing the illusion that the coin has gone somewhere outside the housing or that the coin is simply missing.

30 Claims, 13 Drawing Sheets

SAVINGS BOX

FIELD OF THE INVENTION

The present invention relates to a savings box having a housing having a mirror surface disposed in the middle of the interior thereof and a slide assembly with which a coin is to be inserted into the savings box, the savings box being so designed that, after insertion, the coin is not visible, which will provide the illusion that the coin had not in fact been put into the box or that the coin is missing. Thus, it will be a fun to watch.

In particular, the present invention relates to a savings box in which the existence of a mirror surface is not concealed from the user but deliberately exposed to the user, thus enhancing the illusion that the coin is missing. However, the actual position of the mirror is, in effect, concealed by diverting the viewers attention so that the mirror surface appears to be on the rear surface of the savings box.

BACKGROUND OF THE INVENTION

An example of savings box of the above kind, is known from U.S. Pat. No. 4,967,953 issued Nov. 6, 1990 to Sugawara. The savings box comprises a housing composed of six opaque panels. A transparent window is formed in one of the six panels. A partition is disposed in a plane defined by a diagonal of a predetermined one of the four panels adjacent to the panel having the window and by a diagonal of another panel opposite to the predetermined panel and which is parallel to the diagonal of the certain panel. The partition divides the internal space of the housing into first and second, front and rear, spaces or compartments. A light-reflecting or mirror surface is provided on substantially the entire surface of one side of the partition that faces the window. The housing has formed therein a coin slot which communicates with the second, rear compartment.

A coin that has been inserted through the coin slot and received or deposited in the rear compartment is not visible when viewed through the window as the coin is hidden behind the mirror surface and partition. As a result of reflection by the mirror, when the front compartment of the housing is viewed through the window, the housing interior will look like a hollow box, without the mirror and partition. Thus, the deposited coin is not visible, providing the illusion that it is missing.

In the prior savings box, the mirror is disposed on the diagonal so as to be deliberately concealed so that the housing appears entirely hollow and empty.

SUMMARY OF THE INVENTION

An object of the present invention to provide a fun-to-see savings box which provides the illusion that a coin deposited in the box is missing.

The above object is accomplished by providing a box-like housing including a front panel having a transparent window and an opaque rear panel, opaque side panels extending from the front to the rear panel and; a partition extending between the side panels, across the center of the housing with the front and rear panels being disposed symmetrically on respective opposite sides of the partition so that the partition divides the housing into front and rear spaces or compartments located forwardly and rearward of the partition, respectively; a light-reflecting area or mirror surface formed on a side of the partition which faces the front panel so as to extend over substantially the entire surface of the side; and a slide assembly consisting of front and rear slides receivable in front and rear compartments, respectively, and mounted on the housing for sliding movement between a first, coin receiving position, in which the slide assembly is withdrawn from the housing enabling a coin to be set on the slide assembly and, a second, coin depositing position in which the slides are received in the first and rear compartments, respectively, with the coin deposited by the rear slide in the rear compartment concealed behind the mirror surface so that it cannot be seen through the window. As the mirror surface is disposed centrally of the housing, the reflections of the inner walls of the first compartment in the mirror appear as if those of the rear compartment so that the housing will appear hollow and without the partition, when the housing interior is viewed from the transparent front panel, thus providing the illusion that the savings box is a box having a mirror provided on the inner surface of the rear panel.

Thus, when a coin is put into the savings box, it is not visible to the viewer, as if it were removed from the box or otherwise missing. The savings box is fun to see.

Preferably, illustrations are provided on the slides, illustrations on the front slide being different from illustrations on the rear slide so that one of the illustrations is seen when the slide assembly is set in one of the positions and the other is seen when the slide assembly is set in the other position.

Desirably, illustrations are provided on the front panel including the window for reflection by the mirror surface so that the illustrations seem to a viewer through the window to be provided on the rear panel enhancing the illusion that the front space extends for the entire depth of the housing.

In another preferred form of the invention, the rear panel is extended by a coplanar protrusion having a mirror surface on the a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

An illustration may be provided on a front surface of the protrusion so as to be coplanar with the image reflected by the mirror surface of the partition, thereby enhancing the illusion that the image reflected by the mirror surface of the partition is also provided on the rear panel and that a viewer looking through the window can see a space extending for the entire depth of the housing.

Similar decorations, patterns or colors may be provided on a rear surface of the front slide and a front surface of the rear slide so that, the appearance of the rear surface of the front slide and the front surface of the rear slide are both similar to each other and different from the appearance of a front surface of the front slide so that, on movement of the slide assembly into the space in front of the mirror surface, an image of the rear surface of the front slide as reflected by the mirror surface will seem to be a continuation of the front surface of the rear slide thereby diverting attention of the viewer from the presence of the mirror surface.

In a preferred embodiment of the invention, the coin receiving means comprises coin locating means provided on the second slide assembly and a coin admitting aperture formed in the front slide member in alignment with the coin receiving means through which aperture a coin can be inserted into the coin locating means. This assists in ensuring that the users gaze is concentrated from the front of the savings box.

BRIEF DESCRIPTION OF THE DRAWINGS

Specific embodiments of the invention will now be described by way of example only and with reference to the accompanying drawings in which.

DETAILED DESCRIPTION OF THE PREFERRED EMBODIMENTS

Figure 1:
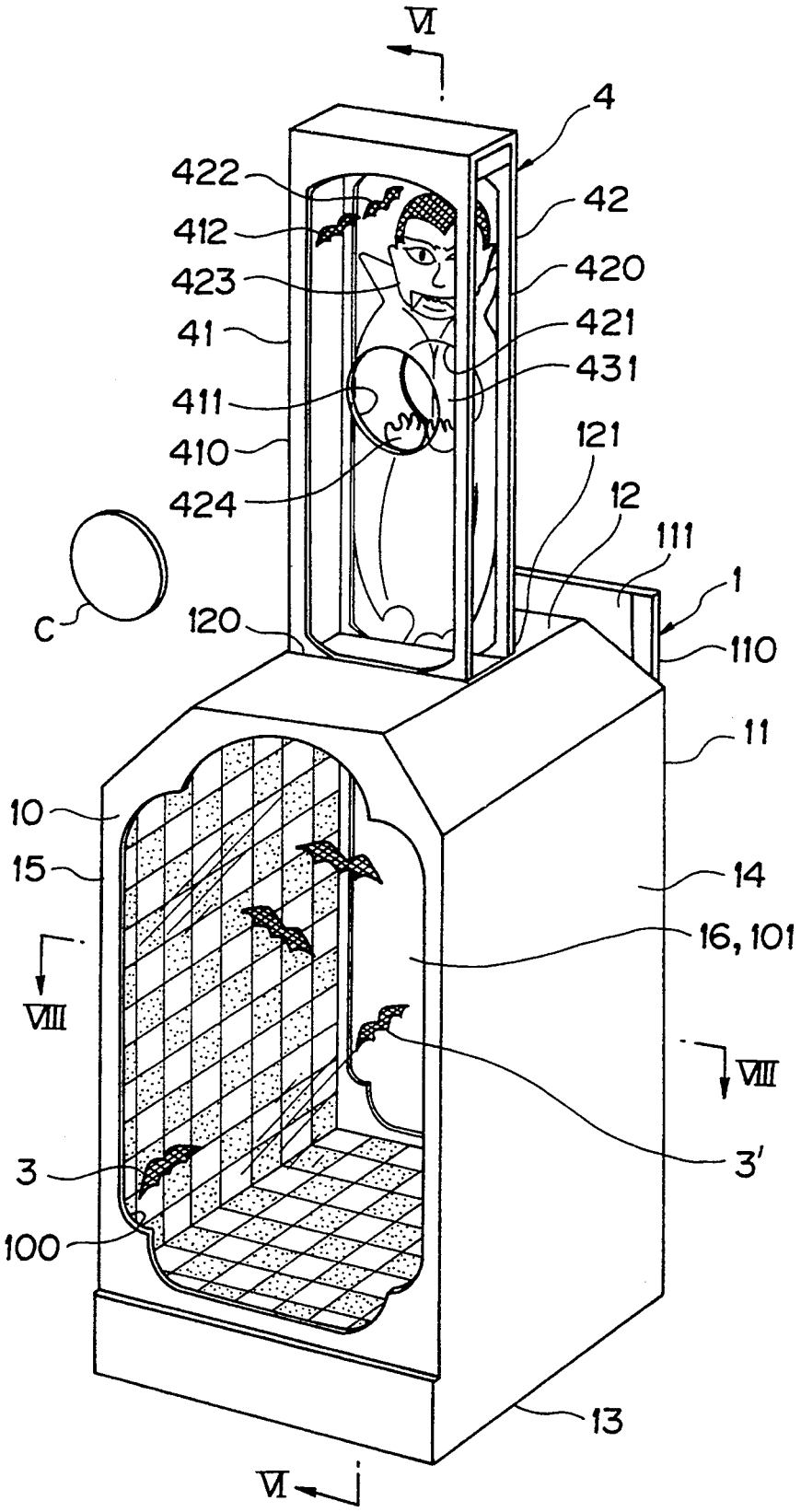
FIG. 1 is a perspective view of an embodiment of the savings box according to the present invention, with the slide assembly being set in the first position.

As shown in FIG. 1 through 4 and 6 through 9, a hollow housing 1 has the form of a rectangular parallelepiped in which both the right and left upper corners are chamfered. The housing 1 comprises a front panel 10 and rear panel 11, which are opposite each other, top panel 12, bottom panel 13, right side panel 14 and left side panel 15, disposed as side panels extending from the front panel 10 to the rear panel 11 and joining respective opposite side edges of the front and rear panels 10 and 11. The housing 1 defines a container providing a savings box according to the present invention. The front panel 10, rear panel 11, top panel 12, bottom panel 13, right and left side panels 14 and 15 are made of an opaque synthetic resin.

The front panel 10 is hexagonal in shape with both the upper right and left corners removed, and it has a transparent window 16 formed to extend over substantially the entire area of the surface thereof. The window 16 consists of an opening 100 formed in the front panel 10 and a transparent synthetic-resin plate 101 attached to the inner wall of the front panel 10 to cover the opening 100. It should be noted that the window 16 may be constituted simply by the opening 100 formed in the front panel 10, without the clear plate 101. Alternatively, the window 16 may be a front panel which itself is clear. The periphery of the window may be defined by applying an opaque ink or tape along the circumference of a clear front panel.

The rear panel 11 is rectangular, having a longer side a little longer than that of the front panel 10 and a shorter side of the same length as that of the front panel 10.

The top panel 12 is made of a rectangular plate in which both the right and left end portions are bent, and consists of a central horizontal portion and inclined right and left ends, corresponding to the top side and oblique sides, respectively, of the front panel 10. The central horizontal portion has two slits 120 and 121 formed therein, parallel to each other and symmetrically with respect to the center line thereof; (the center line is not illustrated herein but it is in substantially the same position as a plane 17, which will be discussed below). Inwardly protruding slide guides 122 and 123 are provided on the inner wall of the central horizontal portion, and are formed integrally with the edges of the slits 120 and 121, respectively.

The bottom panel 13 is rectangular, having a longer side which is of substantially the same length as the shorter sides of the front and rear panels 10 and 11 and a shorter side of substantially the same length as that of the top panel 12.

Both the right and left side panels 14 and 15 are rectangular, having longer sides of nearly the same length as that of the front panel 10 and shorter sides of nearly the same length as that of the bottom panel 13.

Figure 10:
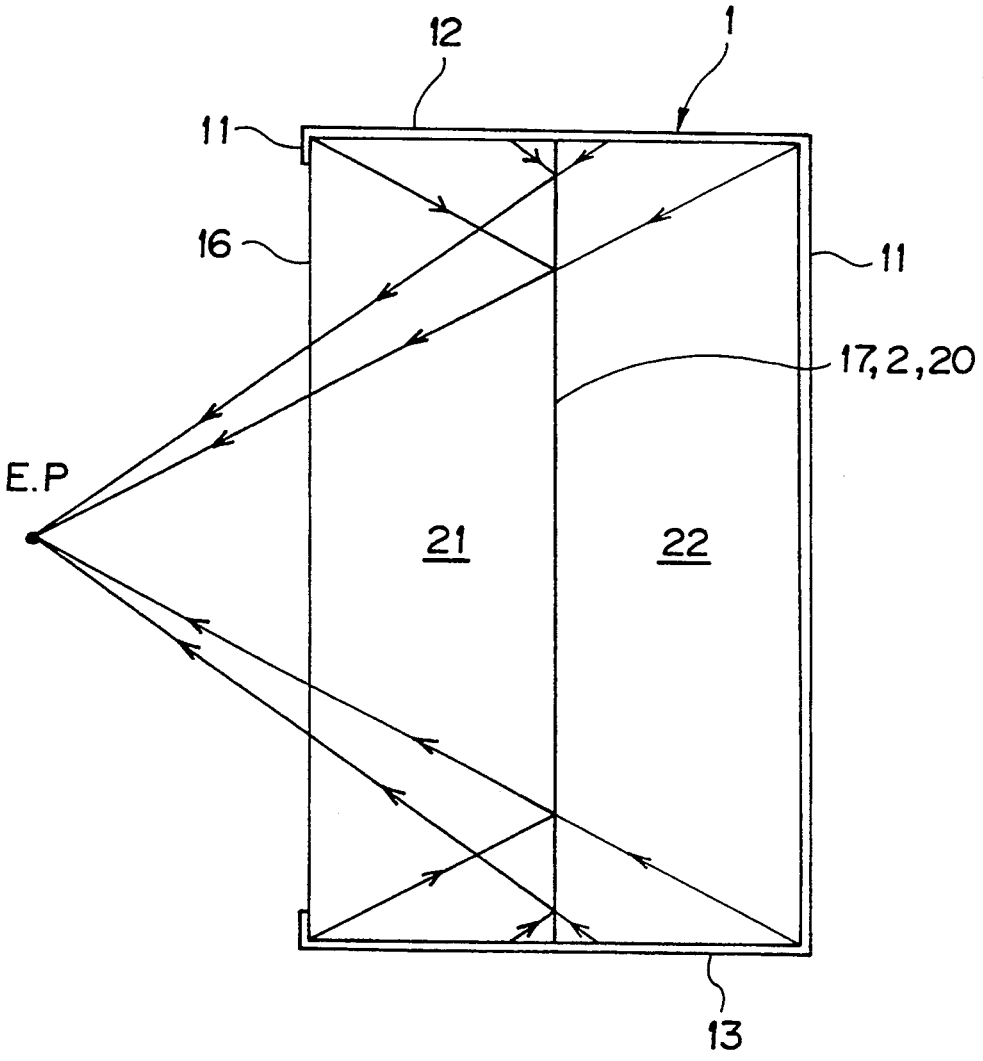
FIG. 10 is ray diagram, showing the optical principle of operation of the savings box.
Figure 11:
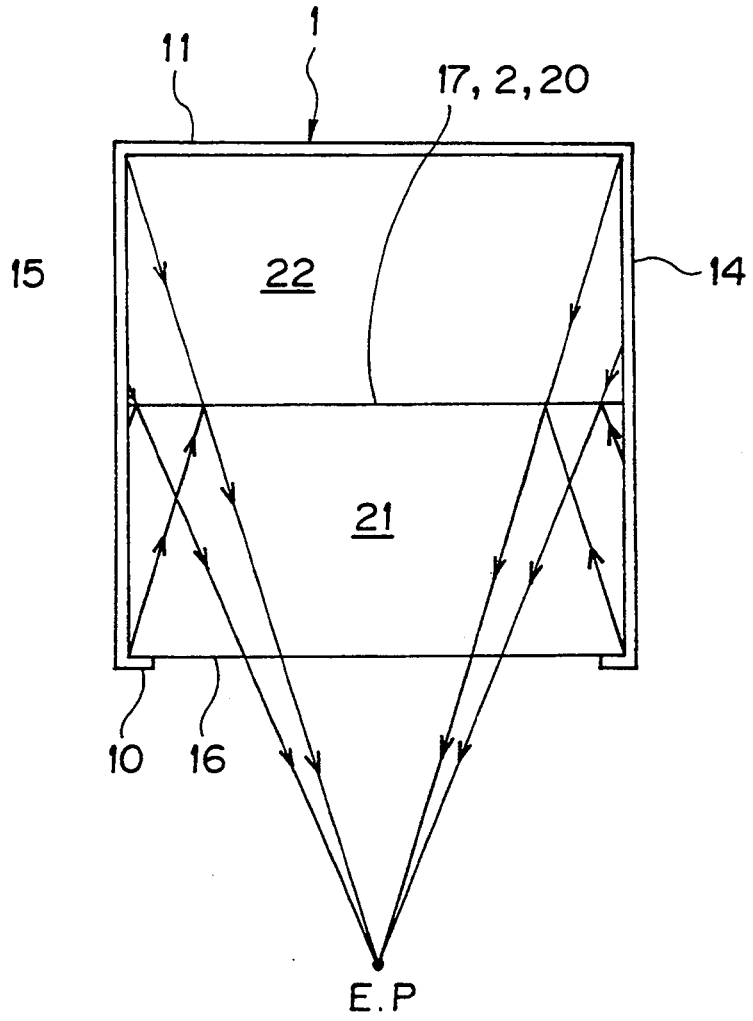
FIG. 11 is further ray diagram, also showing also the principle of operation thereof.

The front panel 10 and rear panel 11 are disposed in parallel relation and opposite to each other in symmetry with respect to a plane 17 shown in FIG. 10 and 11. The top panel 12, bottom panel 13, and right and left side panels 14 and 15 extend between the front and rear panels 10 and 11, (from the front to the rear panels). The top panel 12 and bottom panel 13, and right and left side panels 14 and 15 are all perpendicular to the plane 17. All these panels 12, 13, 14 and 15 are joined to the front panel 10 with their respective front ends located along the perimeter of the hexagonal parallelepiped form of the front panel 10.

A portion (top) 110 of the rear panel 11 protrudes above the front panel 12. A mirror surface 111 is provided on the front side of the protrusion 110. The mirror surface 111 on the protrusion 110 is an aluminum foil bonded to, or a thin aluminum layer vaporized on, the surface of a thin film made of a flexible synthetic resin, or a thin film of aluminum. Note that any decorations such as illustrations of a bat or any characters drawn on a cardboard or similar carrier and cut from it may be attached to the front surface of the protrusion 110 (on the side opposite the front panel 10).

Figure 6:
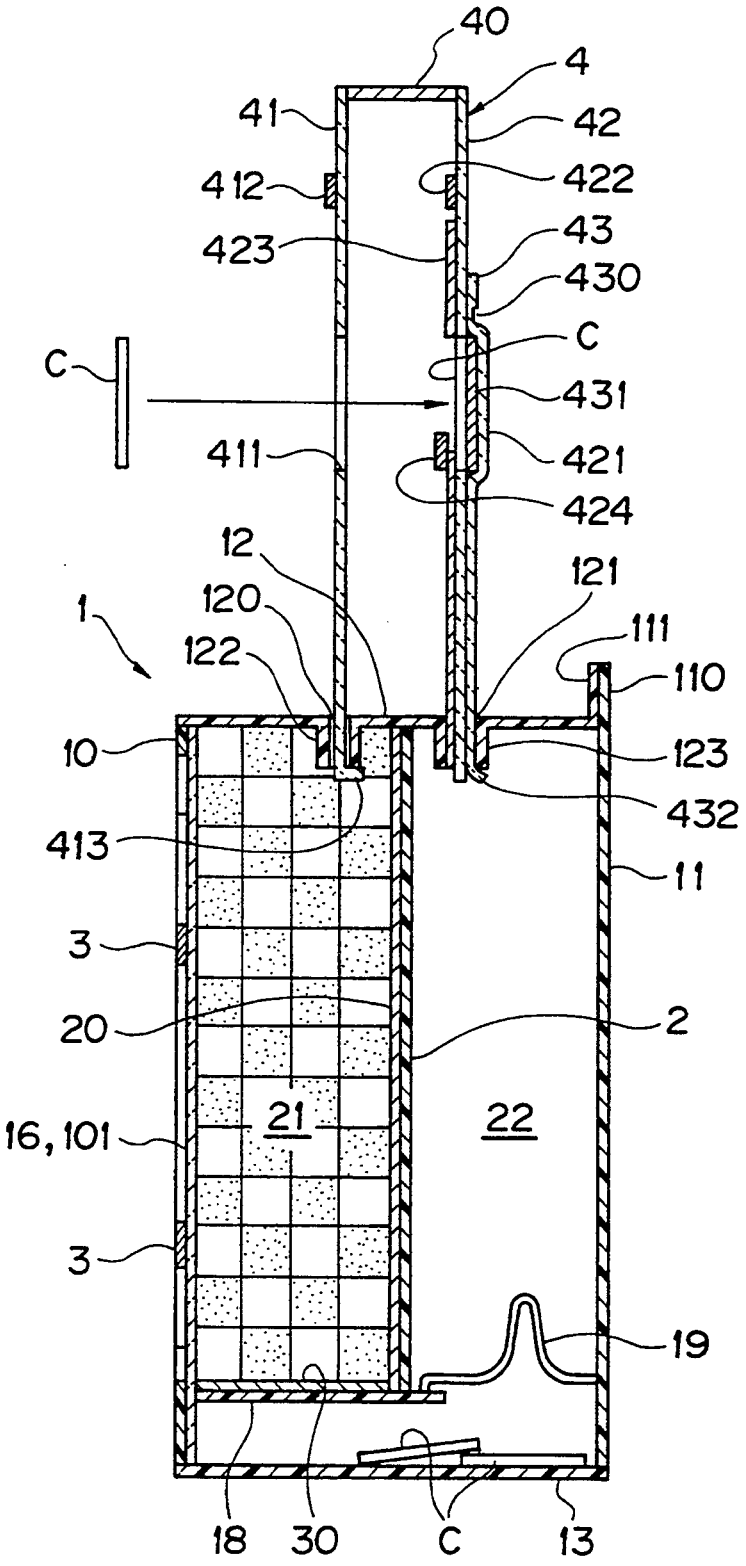
FIG. 6 is a sectional view taken along line VI—VI in FIG. 1.
Figure 7:
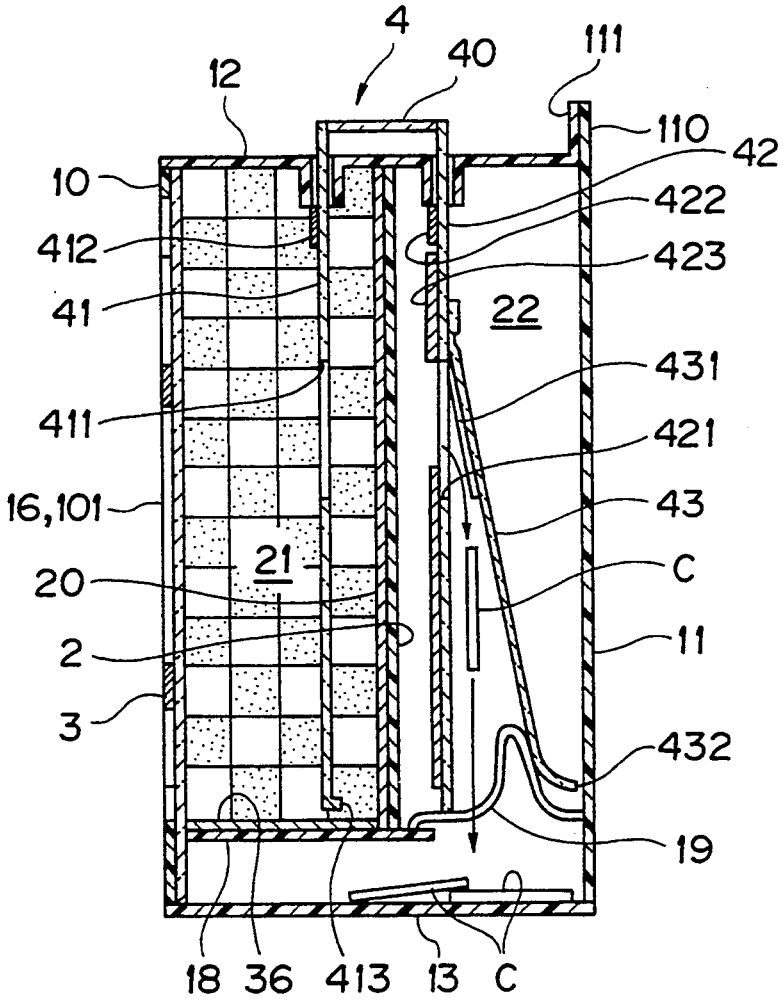
FIG. 7 a sectional view taken along the line VII—VII in FIG. 2.
Figure 8:
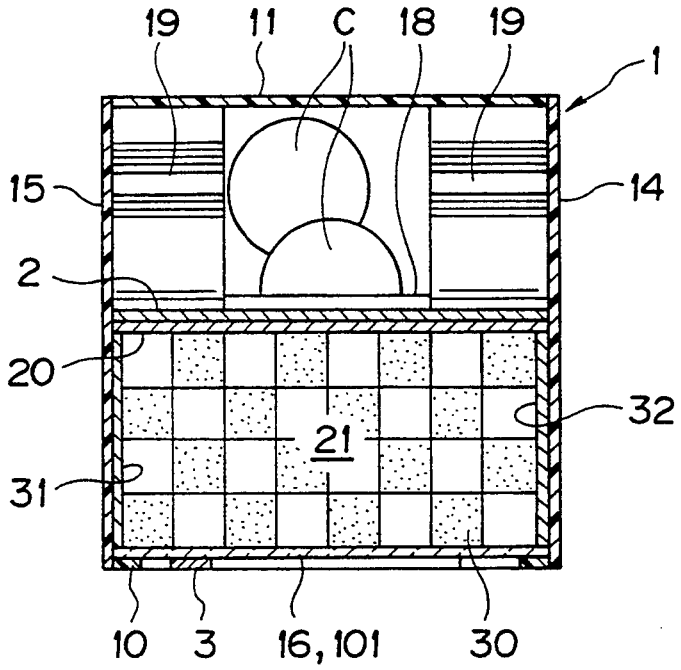
FIG. 8 is a sectional view taken along the line VIII—VIII in FIG. 1.
Figure 9:
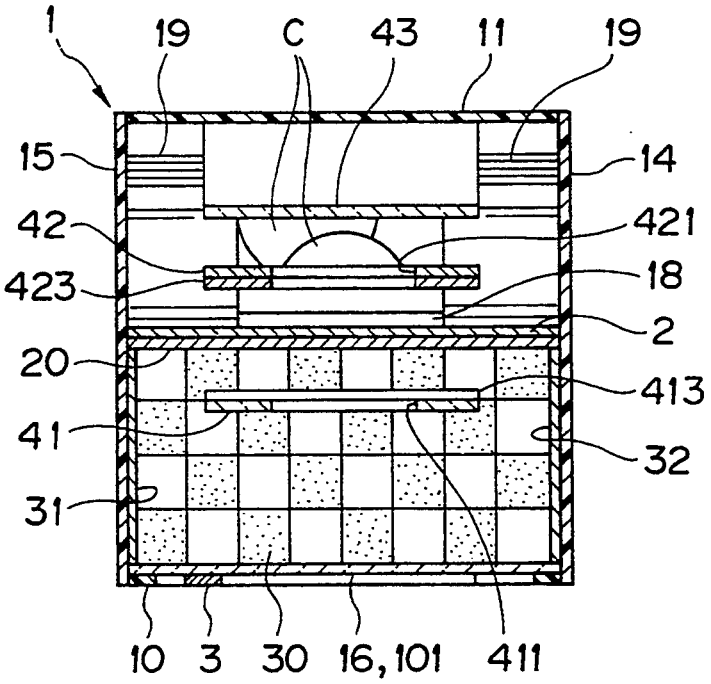
FIG. 9 is a sectional view taken along the line IX—IX in FIG. 2.

A lower horizontal partition 18 is provided at a lower portion of the interior of the housing 1, as shown in FIGS. 6 and 7, and is fixed horizontally on the inner walls of the front panel 10 and right and left side panels 14 and 15 at a position lower than the lower end of the window 16. The horizontal partition is open at the end thereof adjacent to the rear panel 11.

A guide 19 is provided in a lower region of the interior of the housing 1 and fixed to the inner walls of the right and left side panels 14 and 15 at a position near the rear panel 11. This guide 19 is provided to open a cover 43 of the slide assembly 4 which will be described later.

A flat partition 2 is made of an opaque synthetic resin and divides the interior space of the housing 1 into a front compartment 21 and rear compartment 22. The partition 2 has the same hexagonal form as, but a size smaller than, the front panel 10. The partition is fixed to the inner walls of the top panel 12, right and left side panels 14 and 15 and to the top side of the lower horizontal partition 18 so that it extends inside the housing 1 in the plane 17.

A mirror surface 20 extends over substantially the entire surface of the side of the partition 2 facing or opposite the window 16. The mirror 20 is an aluminum foil bonded to, or a thin aluminum layer vaporized on, the surface of a thin film made of a flexible synthetic resin, or a thin film of aluminum. The mirror 20 is bonded onto, or superimposed separately on, the surface of the partition 2 facing the window 16. It should be noted that the mirror 20 may be an aluminum foil bonded directly, or a thin aluminum layer vaporized, on the surface of the partition 2 facing the window 16.

Illustrations 3 may be secured on the inner or outer surface or on both surfaces of the window 16. The illustrations 3 are cut from a cardboard carrier or from similar material as shown in FIGS. 1 through 4 and 15 through 19. The illustrations 3 are painted or inked on both sides thereof but in different colors. For example, they are colored in purple on one side (front side) thereof while in black on the other side (rear side). Note that any characters or decorations other than such illustrations 3 may be applied on the inner or outer surfaces or both surfaces of the window 16.

Sheets 30, 31 and 32, respectively, each have a pattern marked thereon. The patterned sheets 30, 31 and 32 are thin sheets of cardboard or similar material having, for example, a checkered pattern, formed on the inner surface thereof, as shown in FIGS. 6 through 9. The patterned sheet 30 for the bottom panel is rectangular with a longer side of substantially the same length as the shorter side of the front panel 10 and a shorter side of substantially the same length as the distance from the front panel 10 to the mirror 20 or to the partition 2. The patterned sheet 30 is secured to the upper surface of the lower horizontal partition 18. The patterned sheets 31 and 32 for the right and left side panels are rectangular with longer sides of substantially the same length as the distance from the corner defined by the front panel 10 and top panel 12 to the lower horizontal partition 18 and a shorter side of substantially the same length as the distance from the front panel 10 to the mirror 20 or partition 2. These patterned sheets 31 and 32 are secured to the inner surface of both the right and left side panels 14 and 15.

A slide assembly 4 is mounted on the housing 1 for sliding movement between the first and second positions. The slide assembly 4 consists of a front slide 41 and rear slide 42, and a coupling or bridge 40 extending transversely between the slides. The front and rear slides 41 and 42 are so disposed that, when located in the first position, they extend, in opposed, parallel relation on respective opposite sides of the partition 2 and mirror 20, respectively, spaced by a small gap from the latter, respectively bridged by the coupling. The front slide 41 is received in the front compartment 21 while the rear slide 42 is received in the rear compartment 22. The coupling 40 is fixed to the upper ends, respectively, of the front and rear slides 41 and 42' remaining outside the housing. The front slide 41 is made of a clear (transparent) synthetic resin sheet, for example, and has an edging 410 formed with a colored tape or paint provided along the circumference thereof. The front slide 41 has a substantially central, circular through-hole or aperture 411, through which a coin can be passed. The front slide 41 has an illustration 412 secured at the left upper portion of the front side (opposite to the front panel 10) or rear side (opposite to the rear panel 11) thereof. This illustration 412 is a pattern of a bat cut from a cardboard or similar material. It should be noted that any characters or decorations other than such illustration 3 may be provided on the front slide 41. Furthermore, a stopper 413 formed as flange extending toward the mirror 20 or partition 2, is provided on the lower end of the front slide 41*a*.

The rear slide 42 is also made of a clear synthetic resin, for example, and has an edging 420 formed with a colored tape or paint provided along the circumference thereof. The appearance (color, patterning or decoration) of the edging 420 on a front surface of the rear slide is the same as the appearance of the edging on the rear surface of the front slide but both are different from the appearance of the front surface of the edging on the front side of the front slide. The rear slide 42 has a substantially central coin admitting through-hole or aperture 421, through which a coin can pass. An illustration 422 is secured on an left upper portion of the front or rear side thereof and in the same position as the illustration 412 on the front slide 41. This illustration 422 is a silhouette or pattern of a bat cut from cardboard or similar material. Furthermore, another illustration 423 is secured to the front side of the rear slide 42. This illustration 423 is a figure of, for example, a Count Dracula, a legendary centuries-old vampire of the Transylvania of eastern Europe, cut from a cardboard or similar material. The cardboard figure of Count Dracula has a cut-out aligned with the through-hole 421, and a little raised cardboard lip 4 is provided at the lower edge of the through-hole 421 corresponding to the Count Dracula's hands in the illustration 423. Note that the illustrations 422 and 423 may be any other characters or decorations.

A cover 43 is secured at an upper end thereof to the rear side of the rear slide 42 at a position just above the through-hole 421 for pivotal opening movement away from the rear slide 42. The cover 43 is made of a clear synthetic resin sheet and has a score 430 in the rear side at the upper end thereof as shown in FIGS. 6 through 9. The upper portion of the cover 43 above the score 430 is fixed to the rear slide 42 using an adhesive or similar technique. The portion of the cover 43 below the cut 430 can pivot open rearward as a result of the score 430. An illustration 431 is secured to the front side of the cover 43 in a position corresponding to the through-hole 421 in the rear slide 42. This illustration 431 is the chest portion corresponding to that cut out of the figure of the Count Dracula in the illustration 423 on the rear slide 42. The cover 43 has a stopper 432 formed by a flange at the lower end thereof which flange extends rearward toward the rear panel 11. It should be noted that the upper portion of the cover 43 may be pivotally secured to the rear slide 42 by a flexible adhesive tape in place of the hinge portion formed by the score.

The front slide 41 and the rear slide 42 together with the cover 43 of the slide assembly 4 are slidable vertically into the respective slits 120 and 121 in the housing 1 for sliding between the first and second positions.

In the first position shown in FIGS. 1, 3, 6 and 8, the stoppers 413 and 432 of the slide assembly 4 abut respective lower ends of the slide guides 122 and 123. More particularly, the slide assembly 4 is drawn out of the housing 1 so that a coin C can be set in the through-hole 421 in the rear slide 42 of the slide assembly 4, as shown in FIGS. 1, 3, 6 and 8. When the slide assembly 4 is in this first position, the cover 43 is closed against the rear slide 42 received in the slit 121 and cooperates with the hands 424 of the illustration 423 of the Count Dracula in order to keep the coin against dropping down from the through-hole 421.

In the second position shown in FIGS. 2, 4, 7 and 9, the front slide 41 and the rear slide 42 together with the cover 43 of the slide assembly 4 are received in the front and rear compartments 21 and 22, respectively, and the lower end of the rear slide 42 of the slide assembly 4 has been bought into abutment with the guide 19 during the downward movement of the slides, (initial partial opening of the cover having been effected by the weight of the coin), so that the guide cams the cover 43 away from the rear slide 42 into the fully open position. This permits the coin C, previously retained in the through-hole 421 in the rear slide 421, to drop therefrom into the rear compartment 22.

In using the savings box, initially, the slide assembly 4 is lifted up to the first position. In this position, the illustration 412 of the bat on the front slide 41 of the slide assembly 4 can be seen and the illustration 422 of the bat and illustration 423 of the Count Dracula 423 on the rear slide 42 are both seen through the front, clear slide 41.

With the slide assembly 4 retained in the first position, a Coin C is passed through the through-hole 411 in the front slide 41 and set in the through-hole 421 of the rear slide 42, as shown in FIGS. 1 and 6.

Next, the slide assembly 4 is pushed down to the second position, shown in FIGS. 2, 4, 7 and 9 in which the front slide 41 and the rear slide 42 together with the cover 43 of the slide assembly 5 are received in the front and rear compartments 21 and 22, respectively, of the housing 1 and the cover 43 is opened by being pivoted away from the rear slide 42 by the guide 19 so that the coin C held in the through-hole 421 of the rear slide 42 is permitted to fall down from the through-hole 421 and is received into in the rear compartment 22. However, the coin C will not be seen at all after it is moved below the top panel of the housing as the coin will be hidden behind the partition 2 and mirror 20 when the interior of the housing 1 is viewed through the window 16 in the front panel 10.

Figure 2:
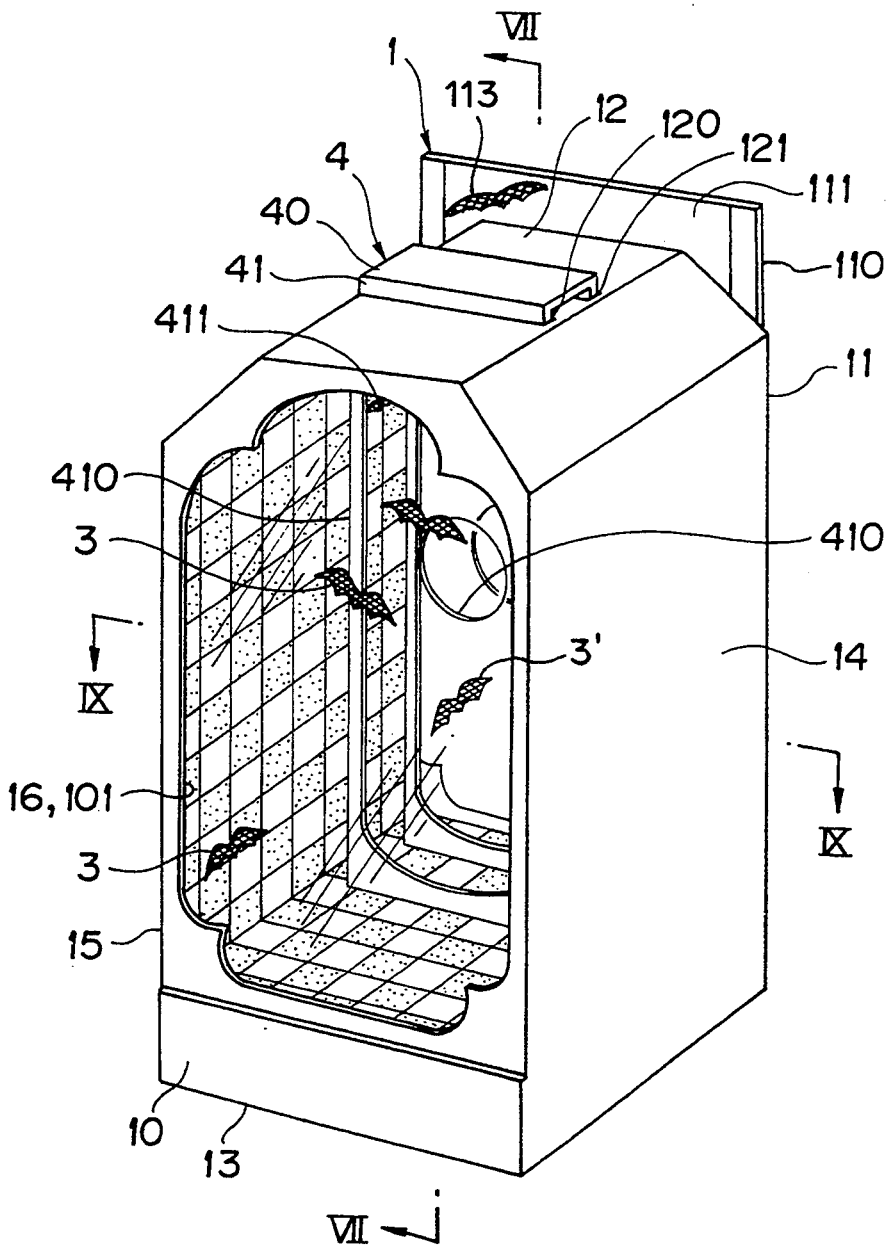
FIG. 2 is a perspective view of the savings box with the slide assembly being set in the second position.
Figure 3:
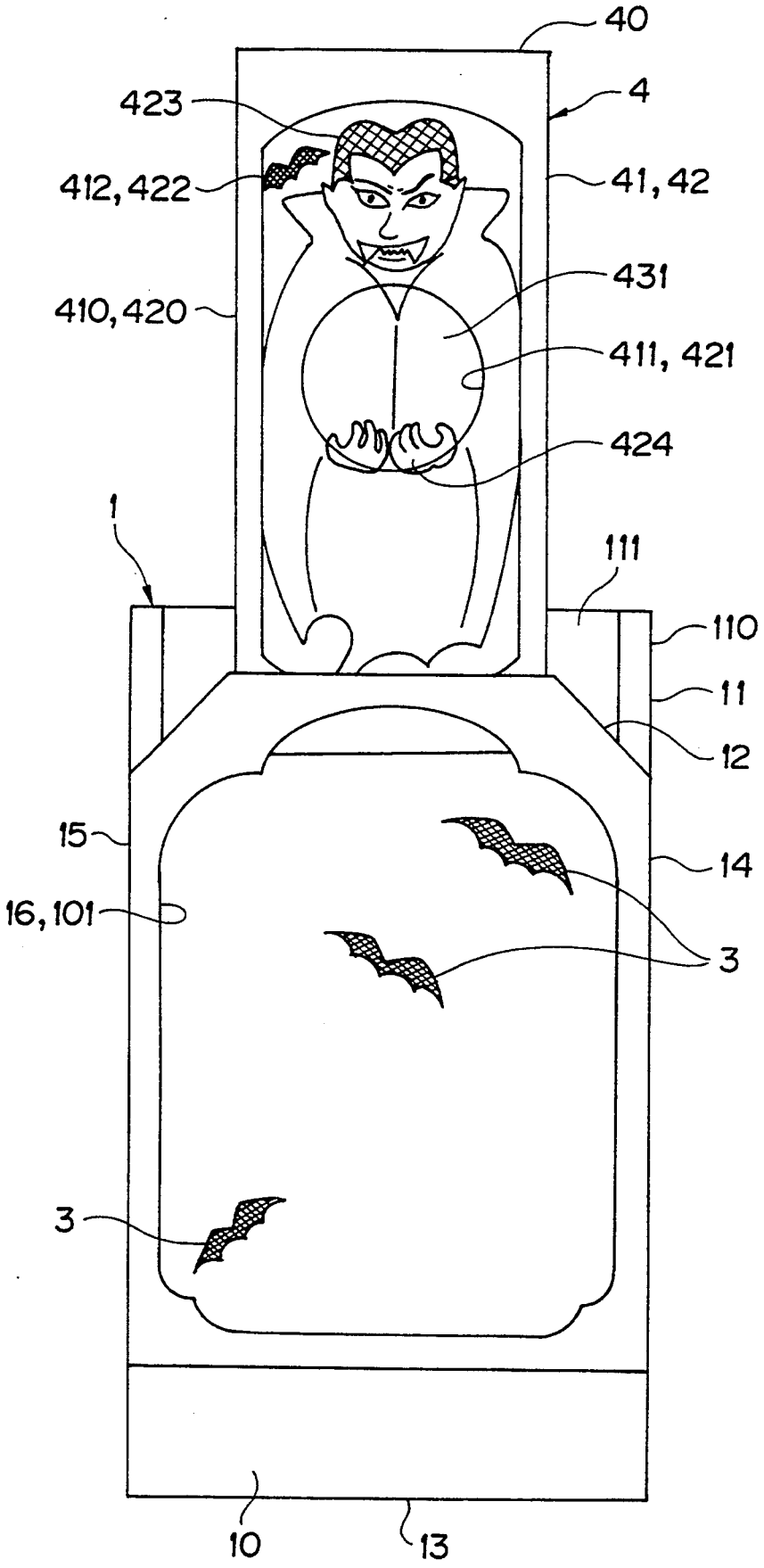
FIG. 3 is a front view of the savings box with the slide assembly being set in the first position.
Figure 4:
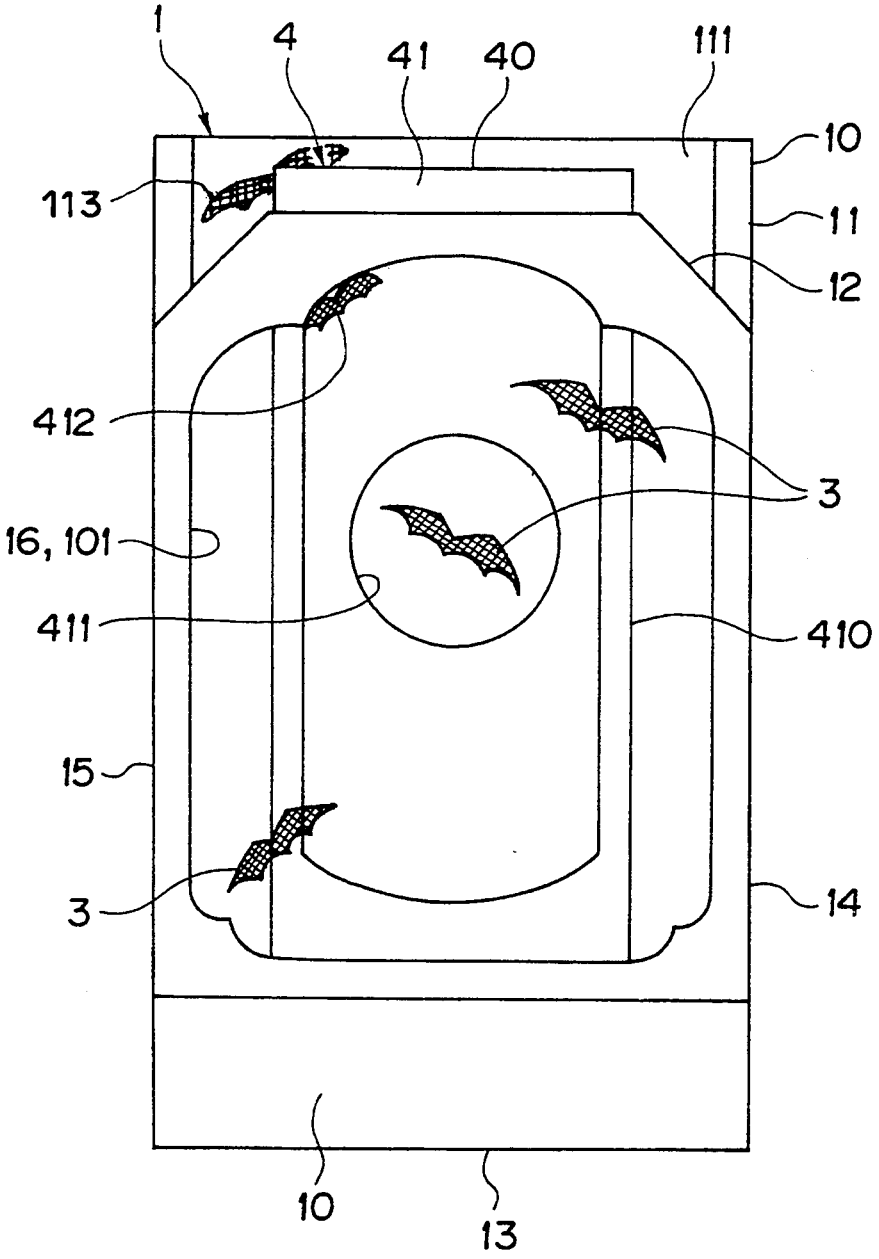
FIG. 4 is a front view of the savings box with the slide assembly being set in the second position.
Figure 5:
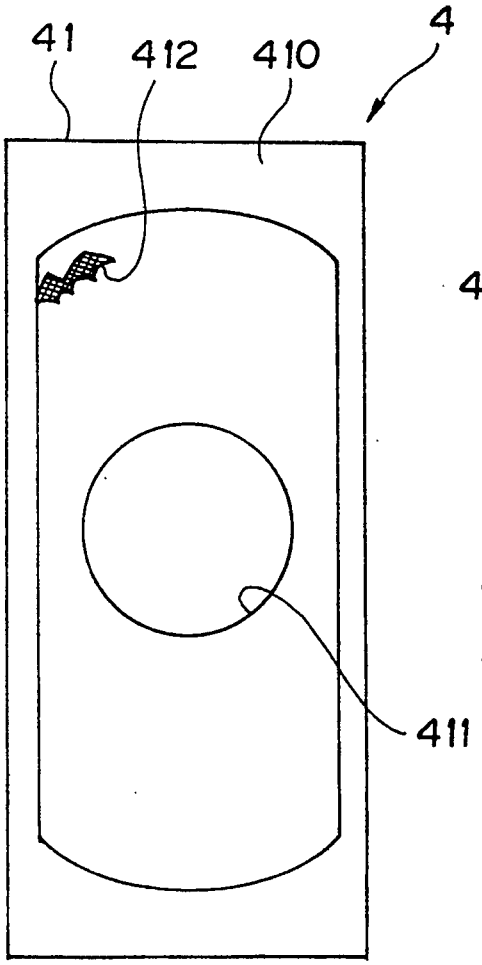
FIG. 5(A) is a front view of a front slide of the slide assembly for receipt in the front compartment.
FIG. 5(B) is a front view of a rear slide of the slide assembly for receipt in the rear compartment.
Figure 5:
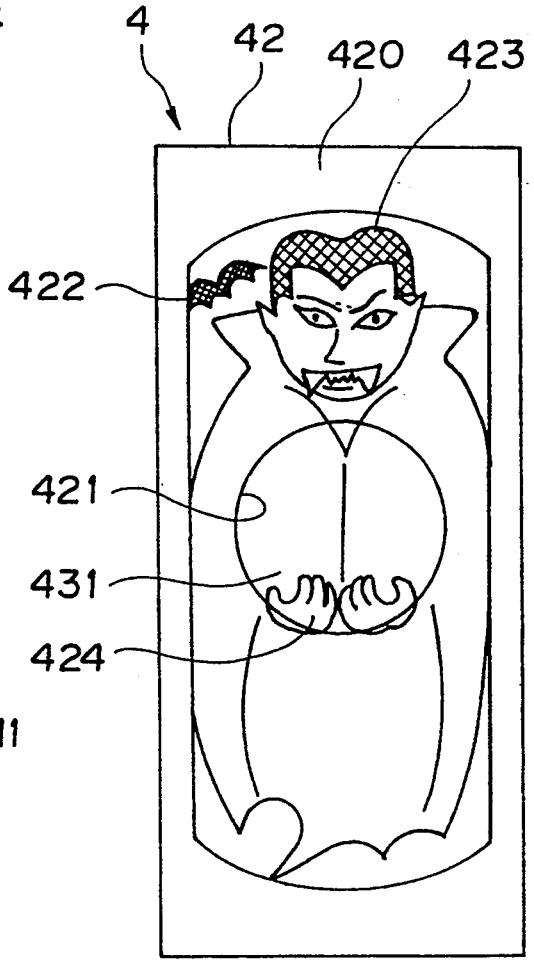

When the slide assembly 4 is located in the second position, the front slide 41 and the rear slide 42, together with the cover 43, thereof are positioned in the front and rear compartments 21 and 22, respectively, as stated above, so that when the interior of the housing 1 is viewed through the window 16 of the front panel 10, the illustration 422 of the bat and illustration 423 of the Count Dracula on the rear slide 42 are not seen as they are hidden behind the partition 2 and mirror 20, as shown in FIGS. 2 and 4. In contrast, the front slide 41 and the illustration 412 of the bat thereon are seen and their reflections in the mirror 20 and appear as if they were the rear slide 42 and the illustration 422 of the bat thereon. This illusion is enhanced by the similarity of the appearances of the rear and front surfaces of the front and rear slides, respectively, and their different appearance from the front surface of the front slide so that an image of the rear surface of the front slide, as reflected by the mirror surface, will seem to be a continuation of the a portion of the front surface of the rear slide still outside the housing thereby diverting attention of the viewer from the presence of the mirror surface.

Thus, when the slide assembly 4 is moved into the second position, the illustration 423 of the Count Dracula seen when the slide assembly 4 is in the first position disappears, which will a fun to see.

In this embodiment of the savings box, the interior space of the housing 1 is divided into the front and rear compartments 21 and 22 by the partition 2 and the rear compartment 22 is not seen as it is hidden behind the partition 2. In the front compartment 21, reflections of the patterned sheets 30, 31 and 32 on the inner walls of the front compartment 21 in the mirror 20 are seen when the interior of the housing 1 is viewed from the point E.P (FIG. 10) through the window 16. Thus, when a viewer glances through the window 16 at the interior of the housing 1, the housing 1 will appear as if it were an empty, hollow box without the partition 2 and with a mirror on the inner side of the rear panel 11, as shown in FIGS. 1 and 4.

Therefore, when the coin C is carried by the slide assembly 4 into the apparently hollow housing with only a mirror on the inner wall of the rear panel the illusion is provided that the coin is removed or missing. More particularly, the savings box according to the present invention provides the illusion of the missing coin, which is fun to see.

Furthermore, the rear panel 11 of the housing 1 is designed to be openable so that the coins C received in the rear compartment 22 can be removed.

More particularly, in the above-mentioned embodiment, the provision of the patterned sheets 30, 31 and 32 on the inner walls of the front compartment 21 of the housing 1 keeps the viewer unaware of the edges of the partition 2 and mirror 20 and also enhances the decorative effect.

In the above-mentioned embodiment, the rear panel 11 is extended by the protrusion 110 and the mirror 111 is provided on the protrusion 110. Therefore, the illusion can be provided that the mirror 20, although located in the plane 17 in the middle of the housing 1, is integrally formed with the mirror 111 on the protrusion 110. Namely, the mirrors 20 and 111 appear as if they were the same, single mirror on the inner wall of the rear panel 11, having interior and exterior portions 20 and 111. The illusion is enhanced by the provision of decorations 113 on the mirror 111 which seem to the viewer to be in the same plane as the reflection 3' of the decoration 3 on the window. Thus, the illusion of the hollow box without the partition 2 is further enhanced, and the illusion of the missing coin is also further intensified.

Furthermore, in the above-mentioned embodiment, the front slide 41 is spaced apart from the mirror 20 by a small distance so that the vertical sliding of the front slide 41 in front of the mirror 20 cannot not possibly scratch the front surface of the mirror 20. Any scratch on the front surface of the mirror 20 would prove that the mirror 20 was located in the plane 17 in the middle of the housing interior.

In the present invention, the shape of the housing 1 is not limited to the aforementioned one, but may be any appropriate shape. More particularly, the housing 1 may have any shape if the front panel 10 and rear panel 11 are positioned symmetrically with respect to the plane 17.

In the present invention, the illustration 3 on the window 16, patterned sheets 30, 31 and 32, the illustrations 412, 422 and 423 on the slide assembly 4, the protrusion 110 and illustration on the protrusion 110 are not always necessary.

Figure 12:
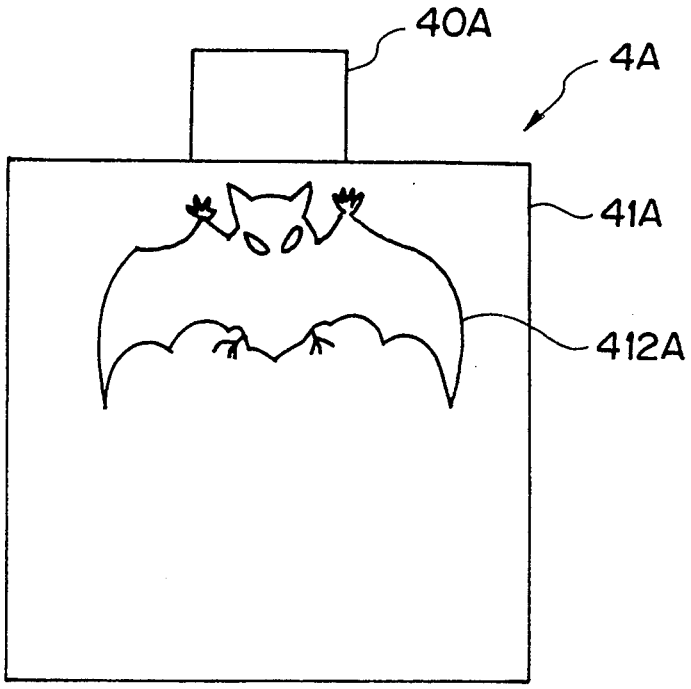
FIG. 12 is a front view of a front slide of a second embodiment of slide assembly.
Figure 13:
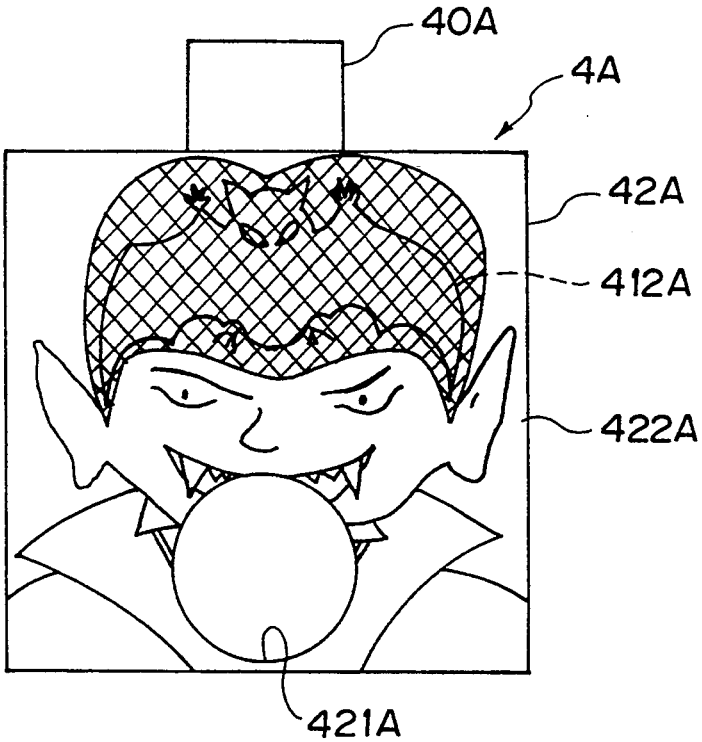
FIG. 13 is a front view of a rear slide of the second embodiment.
Figure 14:
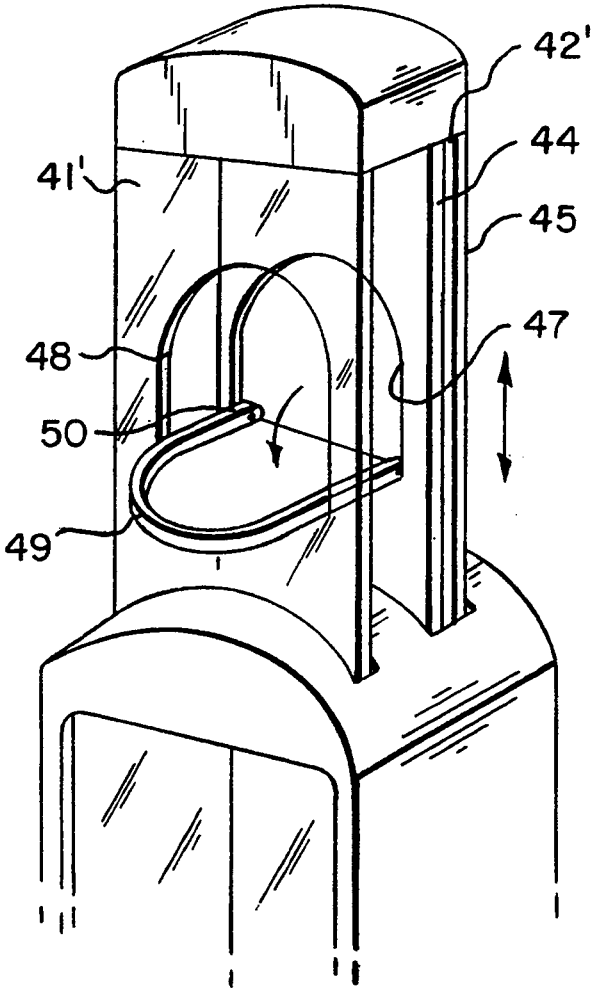
FIG. 14 is a diagrammatic fragmentary perspective view of a further embodiment of the invention with a modified coin receiving slide assembly.
Figures 15A, 15B, 15C, 15D, 15E, 15F, 15G:
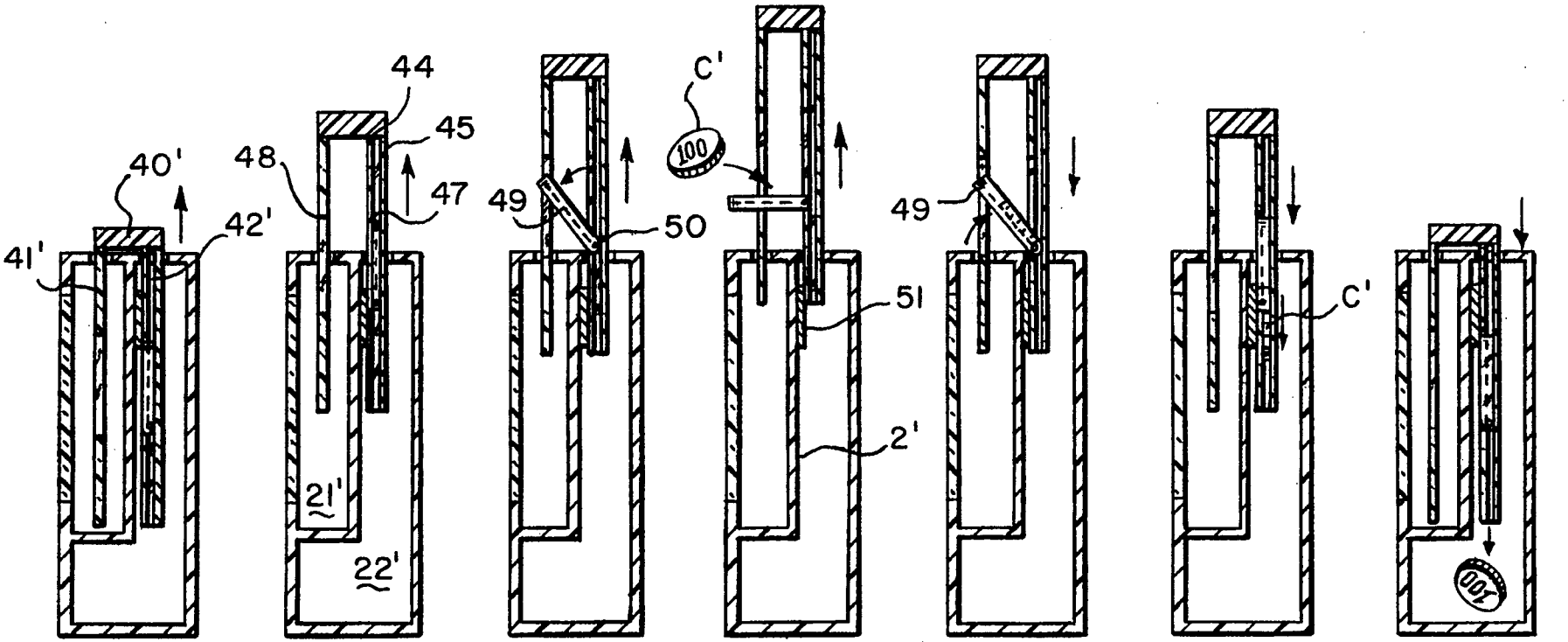
FIG. 15A–FIG. 15G are cross sectional views of the further embodiment of slide assembly in successive operational positions.

In the second embodiment shown in FIGS. 12 and 13, the slide assembly 4A consists of a front slide 41A located in the front compartment 21 and a rear slide 42A located in the rear compartment 22, the partition 2 and mirror 20 being positioned between these slides 41A and 42A, and a tab form coupling 40A is attached to the upper ends of the front slide 41A and rear slide 42A, respectively. The front slide 41A and rear slide 42A are fixed at their upper ends to each other, and they are mounted on the housing 1 for sliding movement between the first and second positions with a small clearance maintained with respect to the mirror 20 and partition 2.

The front slide 41A is made of a clear synthetic resin sheet, for example. The front slide 41A has an illustration 412A secured in the upper center on the front or on the rear side thereof. The illustration 412A is, for example, a cardboard piece cut in the form or profile of a bat.

The rear slide 42A is made of a clear synthetic resin sheet, for example. The rear slide 42A has a circular through-hole or aperture 421A for receiving a coin formed in a lower central portion thereof. The rear slide 42A has an illustration 422A secured on the front or on the rear side thereof. The illustration 422A is, for example, a cardboard piece cut in the form of a Count Dracula. The head of the Count Dracula is so positioned and has such a size as to cover the illustration 412A on the front slide 41A.

When this slide assembly 4A is set in the first position, the illustration 412A of a bat on the front slide 41A and the head of the Count Dracula illustration 422A on the rear slide 42A are superimposed on one another, so that the illustration 412A of a bat (indicated with a broken line) is hidden and only the illustration 422A of the Count Dracula is seen, as shown in FIG. 13. When the slide assembly 40A is set in the second position, the front slide 41A is positioned in the front compartment 21 and the rear slide 42A is hidden behind the partition 2, so that only the illustration 412A of a bat is seen through the window 16. Thus, the change or switch of the illustrations 412A and 422A as the slide assembly 4A is moved from the first to the second positions will be fun to see.

Note that, in addition to the change in the illustrations, the slides can be made so that their color or pattern is changed or switched by such movement.

In the further embodiment shown in FIG. 14 and FIG. 15A–15G, the modified slide assembly comprises front and rear slides 41′ and 42′, respectively, joined at respective upper ends by a rigid bridge portion 40′. The rear slide 42′ comprises first and second, rigid plate portions 44 and 45, respectively, located face-to-face, in closely spaced, parallel relation, defining between them a coin receiving chute. The front plate portion 44 is formed with coin admitting aperture 47 or cut-out aligned rearward of a coin admitting aperture 48 formed in the front slide 41′. A generally semicircular, coin receiving and locating tray 49 having a generally semicircular, raised, coin retaining lip extending around a front periphery thereof, is pivotally connected by a pivot pin 50 to the front plate portion 44 for pivotal movement between a coin receiving position, corresponding to the first position of the slide assembly, shown in FIG. 15D, in which the coin receiving tray extends horizontally through the coin admitting aperture 48 bridging the front and rear slides and, a coin depositing position, corresponding to the second position of the slide assembly, shown in FIG. 15G, in which the tray has been tipped rearward by engagement with the housing wall during downward movement of the rear slide into the rear compartment 22′ into the coin admitting aperture 47, causing a coin C′ placed thereon to fall from the rear of the tray along the chute defined by the front and rear plate portions 44 and 45, respectively, of the rear slide 42′ and into the rear compartment 22′. A guide 51 for the rear slide 42′ is attached to the rear side of the partition 2′.

In summary, the invention relies for its illusory effect, not on concealing the existence of the mirror surface, but on diverting or misdirecting the attention of the viewer so that the viewer's perception is distorted, at least momentarily, causing the viewer to believe that the mirror surface is in fact located on the rear panel of the housing. This illusion is enhanced by features of the invention such as the illustrations on the window of the front panel which, on reflection by the mirror surface appear to the provided on the rear panel, giving the impression that the housing is empty for its entire depth (front to rear); the mirrored protrusion on the rear panel seeming to be a coplanar extension of the mirror surface of be partition thereby also providing the illusion that the mirror of the partition is located on the rear panel and the provision of illustrations on the mirrored protrusion which illustrations seem to be coplanar with reflections of illustrations provided on the front panel or window. The illusion that the coin has not entered the housing is also enhanced by the reflection of the rear surface of the first slide seeming to be a coplanar extension of the upstanding portion of the second slide remaining outside the housing, (and therefore the inserted part of the second slide itself), during insertion of the slide assembly into the housing as a result of the coloring, illustrations or patterns on the rear surface of the front side and the front surface of the rear slide being both similar in appearance to each other and different from the appearance of the front surface of the front slide.

What is claimed is:

1. A savings box, comprising:

a box-like housing including a front panel having a transparent window and an opaque rear panel, opaque side panels extending from the front panel to the rear panel and;

a partition extending between the side panels with the front and rear panels being disposed symmetrically on respective opposite sides of the partition so that the partition divides the housing into front and rear spaces located forwardly and rearward of the partition, respectively;

a mirror surface formed on a side of the partition which faces the front panel so as to extend over substantially the entire area of the side; and a slide assembly consisting of front and rear slides receivable in front and rear spaces, respectively, and mounted on the housing for sliding movement between a first, coin receiving position, in which the slide assembly is withdrawn from the housing enabling a coin to be set on the slide assembly and, a second, coin depositing position in which the slides are received in the front and rear spaces, respectively, with the coin deposited by the rear slide concealed behind the mirror surface so that it cannot be seen through the window.

2. A savings box as set forth in claim 1, wherein illustrations are provided on the slides, illustrations on the front slide being different from illustrations on the rear slide so that one of the illustrations is seen when the slide assembly is set in one of the positions and the other is seen when the slide assembly is set in the other position.

3. A savings box as set forth in claim 2, wherein a pattern is provided on inner surface portions of the side panels defining the front space.

4. A savings box as set forth in claim 2, wherein the rear panel is extended by a coplanar protrusion having a mirror surface provided on a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

5. A savings box as set forth in claim 4, wherein a pattern is provided on inner surface portions of the side panels defining the front space.

6. A savings box as set forth in claim 4, wherein an illustration is provided on a front surface of the protrusion so as to be coplanar with the image reflected by the mirror surface of the partition, thereby enhancing the illusion that the image reflected by the mirror surface of the partition is also provided on the rear panel and that a viewer looking through the window can see a space extending for the entire depth of the housing.

7. A savings box as set forth in claim 6, wherein a pattern is provided on inner surface portions of the side panels defining the front space.

8. A savings box as set forth in claim 2, wherein illustrations are provided on the front panel including the window for reflection by the mirror surface so that the illustrations seem to a viewer through the window to be provided on the rear panel providing the illusion that the front space extends for the entire depth of the housing.

9. A savings box as set forth in claim 8, wherein a pattern is provided on inner surface portions of the side panels defining the front space.

10. A savings box as set forth in claim 8, wherein the rear panel is extended by a coplanar protrusion having a mirror surface provided on a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

11. A savings box as set forth in claim 10, wherein a pattern is provided on inner surface portions of the side panels defining the front space.

12. A savings box as set forth in claim 10, wherein an illustration is provided on the front surface of the protrusion so as to be coplanar with the image reflected by the mirror surface of the partition, thereby enhancing the illusion that the image reflected by the mirror surface of the partition is also provided on the rear panel and that a viewer looking through the window can see a space extending for the entire depth of the housing.

13. A savings box as set forth in claim 12, wherein a pattern is provided on inner surface portions of the side panels defining the front space.

14. A savings box as set forth in claim 1, wherein illustrations are provided on the front panel including the window for reflection by the mirror surface so that the illustrations seem to a viewer through the window to be provided on the rear panel providing the illusion that the front space extends for the entire depth of the housing.

15. A savings box as set forth in claim 14, wherein a pattern is provided on inner surface portions of the side panels defining the front space.

16. A savings box as set forth in claim 14, wherein the rear panel is extended by a coplanar protrusion having a mirror surface provided on a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

17. A savings box as set forth in claim 16, wherein a pattern is provided on inner surface portions of the side panels defining the front space.

18. A savings box as set forth in claim 16, wherein an illustration is provided on a front surface of the protrusion so as to be coplanar with the image reflected by the mirror surface of the partition, thereby enhancing the illusion that the image reflected by the mirror surface of the partition is also provided on the rear panel and that a viewer looking through the window can see a space extending for the entire depth of the housing.

19. A savings box as set forth in claim 18, wherein a pattern is provided on inner surface portions of the side panels defining the front space.

20. A savings box as set forth in claim 1, wherein the rear panel is extended by a coplanar protrusion having a mirror surface provided on a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

21. A savings box as set forth in claim 20, wherein a pattern is provided on inner surface portions of the side panels defining the front space.

22. A savings box as set forth in claim 20, wherein an illustration is provided on a front surface of the protrusion so as to be coplanar with the image reflected by the mirror surface of the partition, thereby enhancing the illusion that the image reflected by the mirror surface of the partition is also provided on the rear panel and that a viewer looking through the window can see a space extending for the entire depth of the housing.

23. A savings box as set forth in claim 22, wherein a pattern is provided on inner surface portions of the side panels defining the front space.

24. A savings box as set forth in claim 1, wherein a pattern is provided on inner surface portions of the side panels defining the front space.

25. A savings box as set forth in claim 1, wherein one of similar decorations, patterns and colors are provided on a rear surface of the front slide and a front surface of the rear slide so that, the appearance of the rear surface of the front slide and the front surface of the rear slide are both similar to each other and different from the appearance of a front surface of the front slide so that, on movement of the slide assembly into the space in front of the mirror surface, an image of the rear surface of the front slide as reflected by the mirror surface will seem to be a continuation of the front surface of the rear slide thereby diverting attention of the viewer from the presence of the mirror surface.

26. A savings box comprising a housing having a front and a rear and a housing wall extending from the front to the rear and defining an interior space;

a window formed in the front of the housing;

a partition having a mirror surface thereon extending across a center of the interior space of the housing with the mirror surface facing the window so that the mirror surface appears to be mounted in the rear of the housing when viewed through the window;

first and second access slots formed in the housing wall adjacent respective opposite sides of the partition in communication with the interior space on respective opposite sides of the partition;

a slide assembly comprising front and rear slide members joined together in adjacent, face-to-face relation;

coin receiving means on the slide assembly;

the slide members being mounted in respective slots for sliding movement between a first, coin receiving position, in which the slide assembly is withdrawn from the housing enabling a coin to be set on the slide assembly and, a second, coin depositing position in which the slide members are received in the housing interior in front of and behind the mirror surface, respectively, with the coin carried by the rear slide concealed behind the mirror surface so that it cannot be seen through the window.

27. A savings box as set forth in claim 26 in which means are provided on the slide assembly to release the coin from the slide assembly behind the partition during movement of the slide assembly to the second position.

28. A savings box as set forth in claim 26 in which the coin receiving means comprises coin locating means provided on the second slide assembly and a coin admitting aperture formed in the front slide member in alignment with the coin receiving means through which aperture a coin can be inserted into the coin locating means.

29. A savings box as set forth in claim 26 in which the housing has front and rear walls extending substantially parallel to the mirror surface of the partition and the rear panel is extended by a coplanar protrusion having a mirror surface provided on a front side thereof providing the illusion to a viewer from the front of the savings box that the mirror surface of the protrusion is a coplanar continuation of the mirror surface of the partition, thereby enhancing the illusion that the mirror surface of the partition is located on the rear panel.

30. A savings box as set forth in claim 29, wherein illustrations are provided on the front panel including the window for reflection by the mirror surface so that the illustrations seem to a viewer through the window to be provided on the rear panel, providing the illusion that the front space extends for the entire depth of the housing.

* * * * *